US006428751B1

(12) United States Patent
Solazzi

(10) Patent No.: US 6,428,751 B1
(45) Date of Patent: Aug. 6, 2002

(54) SELF-CENTERING SAMPLE CUP ASSEMBLY

(76) Inventor: Monte J. Solazzi, 1904 SW. Whitemarsh Way, Palm City, FL (US) 34990

( * ) Notice: Subject to any disclaimer, the term of this patent is extended or adjusted under 35 U.S.C. 154(b) by 0 days.

(21) Appl. No.: 09/655,564

(22) Filed: Sep. 6, 2000

(51) Int. Cl.[7] ..... B01L 3/00

(52) U.S. Cl. ..... 422/102; 422/99; 422/104; 73/863; 73/864.83; 73/864.84; 73/864.91; 356/246; 250/428; 378/208

(58) Field of Search ..... 422/99, 102, 104; 436/171, 174; 73/864.91, 863, 864.83, 864.84; 378/208, 179, 47; 356/246; 250/428

(56) References Cited

U.S. PATENT DOCUMENTS

| | | | | | |
|---|---|---|---|---|---|
| 4,643,033 | A | | 2/1987 | Solazzi | 73/864.91 |
| 4,818,017 | A | * | 4/1989 | Dykstra et al. | 297/194 |
| 4,915,255 | A | * | 4/1990 | Curtis | 220/408 |
| 5,451,375 | A | | 9/1995 | Solazzi | 422/102 |
| 5,454,020 | A | | 9/1995 | Solazzi | 378/45 |
| 5,556,599 | A | * | 9/1996 | Ahmed | 422/102 |
| 5,630,989 | A | * | 5/1997 | Solazzi | 422/102 |
| 5,891,327 | A | * | 4/1999 | Taunk | 210/85 |
| 5,944,190 | A | * | 8/1999 | Edelen | 206/524.4 |
| 6,009,766 | A | * | 1/2000 | Solazzi | 73/864.91 |

* cited by examiner

*Primary Examiner*—Maureen M. Wallenhorst
(74) *Attorney, Agent, or Firm*—Duane Morris LLP; Arthur L. Plevy

(57) ABSTRACT

A sample cup assembly for use with an analytical instrument having a sample cup holder with an inner diameter which is greater than the outer diameter of the sample cup assembly. The sample cup assembly can include a main cell for retaining a specimen to be analyzed; a collar for locating a thin film over the open end of the main cell such that the film sealingly closes the open end of the main cell; and two or more projections extending outwardly from either the main cell or collar. The projections engage the interior surface of the sample cup holder when the sample cup assembly is installed therein, thereby centering the sample cup assembly within the sample cup holder.

14 Claims, 6 Drawing Sheets

SELF-CENTERING SAMPLE CUP ASSEMBLY

FIELD OF THE INVENTION

This invention relates to sample cup assemblies for use in spectroscopic analysis, and more particularly, to a sample cup assembly having a sample cup centering system that enables the assembly to be utilized without an adapter in a conventionally sized sample cup holder of a spectroscopic instrument.

BACKGROUND OF THE INVENTION

Spectroscopic techniques are commonly used for analyzing various materials. Such techniques rely on the changes that take place in the atoms and molecules of a material when electromagnetic radiation is absorbed or emitted thereby. Technological advancements in both wavelength-dispersive (WD-XRF) and energy-dispersive (ED-XRF) X-ray fluorescence instrumentation enable spectroscopic analysis of virtually all types of materials.

Sample cups of various well known designs are used in spectroscopic techniques to hold or contain liquid, solid and powdered specimens. Many of these sample cups consist of at least three components: a cup-shaped main cell; a thin film of material covering the open end of the cell; and a collar that pulls the thin film of material taut over the open end of the cell. The thin film of material operates as closure for the cup to retain the specimen to be spectroscopically analyzed within the cell, and as a sample surface plane that becomes exposed to an excitation source during the spectroscopic analysis. Such a sample cup is described in U.S. Pat. 5,451,375 entitled APPARATUS FOR TRIMLESS SAMPLE CUP USED IN X-RAY SPECTROSCOPY issued on Sep. 19, 1995 to Monte J. Solazzi.

Spectroscopic instruments typically come equipped with a non-removable sample cup holder of a fixed inner diameter. The bottom of holder includes an aperture for exposing the sample cup assembly to the instrument's excitation source. Only sample cups assemblies with outer diameters complimentary to the inner diameter of the sample cup holder can be mounted therein such that the sample cup assembly is centered within the aperture of the holder. Sample cups assemblies with outer diameters that are significantly less than the inner diameter of the sample cup holder require adapters to center them with respect to the holder's aperture. Improper centering of the sample cup assembly in the sample cup holder of the instrument can detrimentally alter the intensity of radiation impinging upon the specimen from the excitation source, thus causing the spectroscopic analysis to produce erroneous quantitative data.

Accordingly, there is a need for an inexpensive sample cup assembly which can be used in a conventionally sized sample cup holder of a spectroscopic instrument without the use of an adapter.

SUMMARY OF THE INVENTION

A sample cup assembly for use in retaining a specimen, comprising: a main cell for retaining the specimen, the main cell having an open end; a collar for locating a thin film over the open end of the main cell such that the film sealingly closes the open end of the main cell; and at least two projections extending from one of the main cell and collar for centering the sample cup assembly within a sample cup holder of a spectroscopic instrument.

BRIEF DESCRIPTION OF THE DRAWINGS

The advantages, nature, and various additional features of the invention will appear more fully upon consideration of the illustrative embodiments now to be described in detail in connection with accompanying drawings where like numerals are used to identify like elements and wherein.

It should be understood that the drawings are for purposes of illustrating the concepts of the invention and are not to scale.

DETAILED DESCRIPTION OF THE INVENTION

Figure 1:
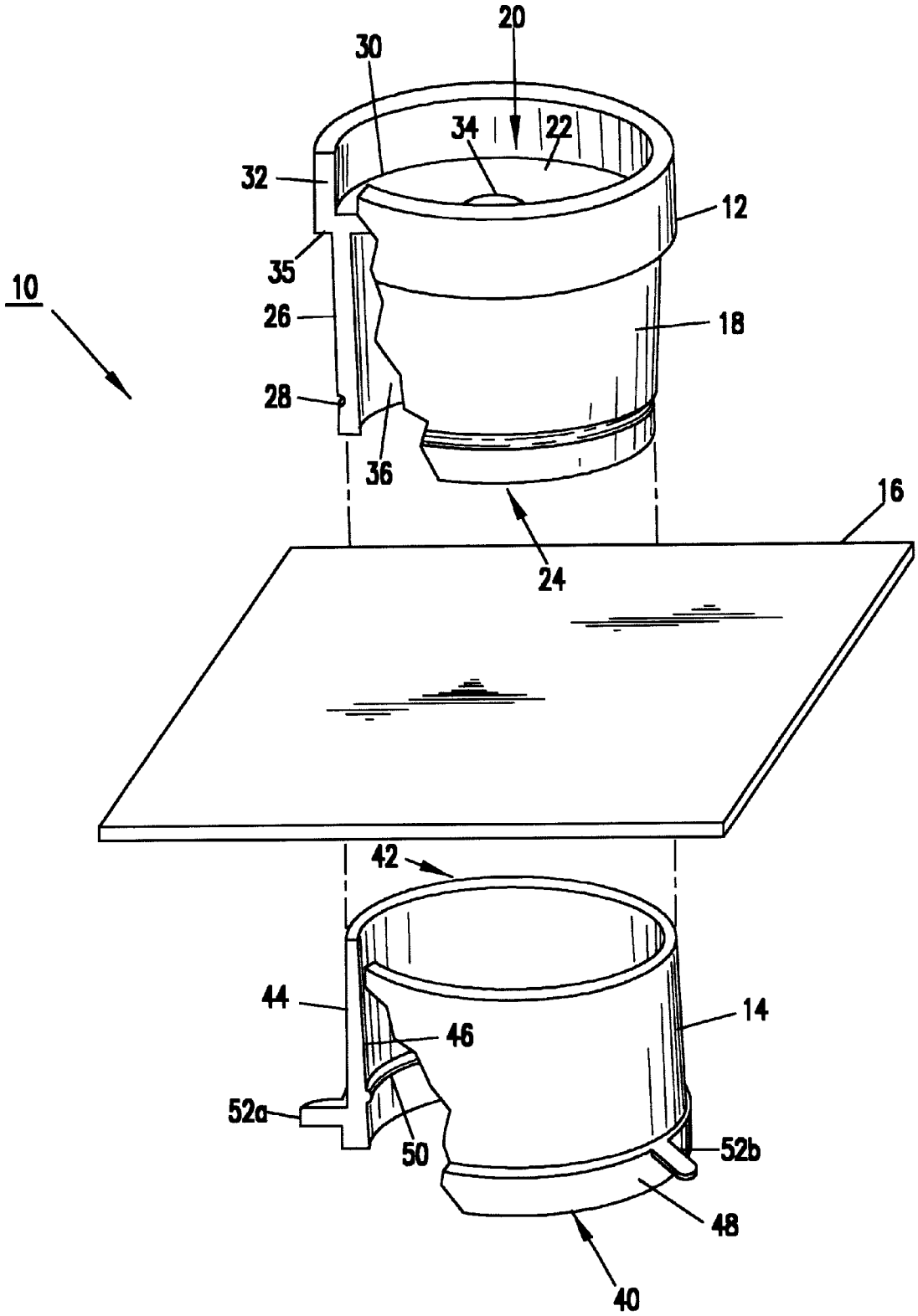
FIG. 1 is an exploded perspective view in partial section of a typical sample cup assembly utilizing an embodiment of the centering system of the present invention.
Figure 2:
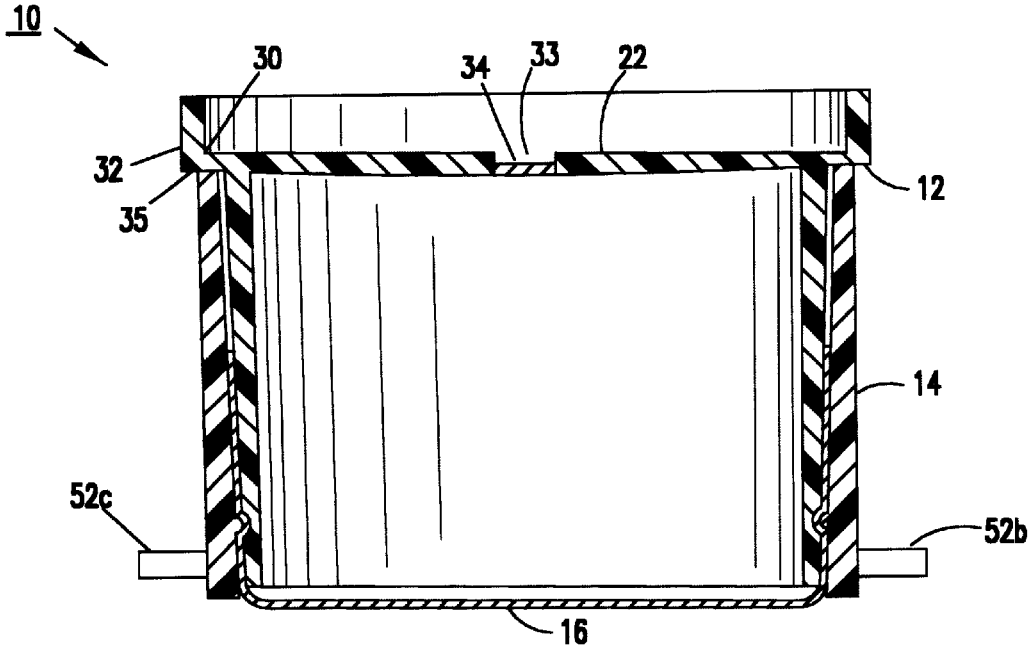
FIG. 2 is a cross-sectional view of the sample cup assembly of FIG. 1.
Figure 3:
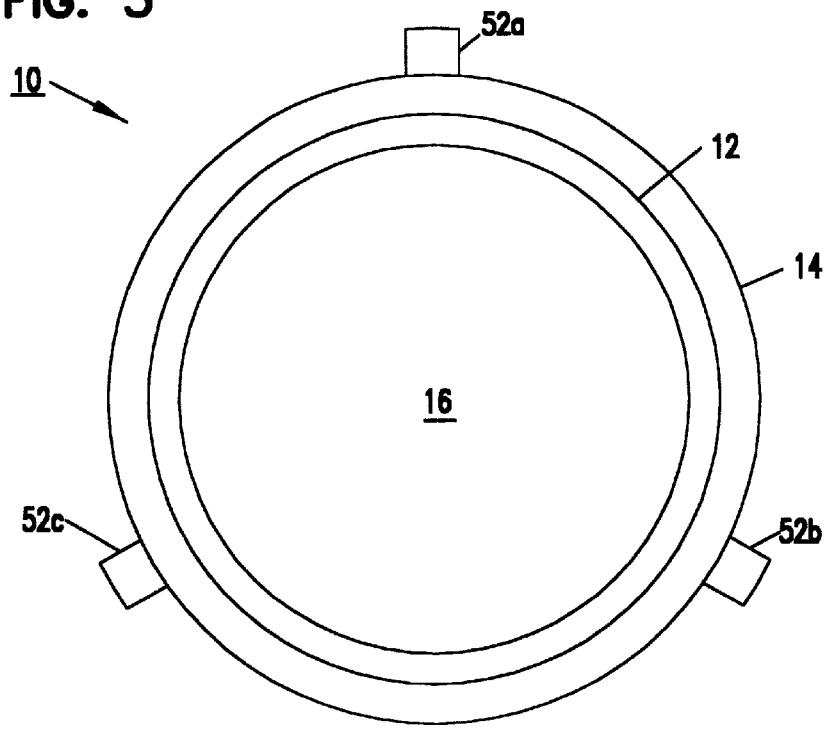
FIG. 3 is an end view (sample film end) of the sample cup assembly of FIG. 1.

FIGS. 1–3 collectively show a typical sample cup assembly 10 which utilizes an embodiment of the centering system of the present invention. The sample cup assembly 10 includes three components: an open cup-shape main cell 12 for holding a specimen to be analyzed, a sheet 16 of thin film material for covering and sealing the cup-shape main cell 12, and a collar 14 for securing the sheet 16 over the main cell 12. Such sample cup assemblies are described in U.S. Pat. No. 5,451,375 to Solazzi. The disclosure of U.S. Pat. No. 5,451,375 is incorporated herein by reference.

Figure 5:
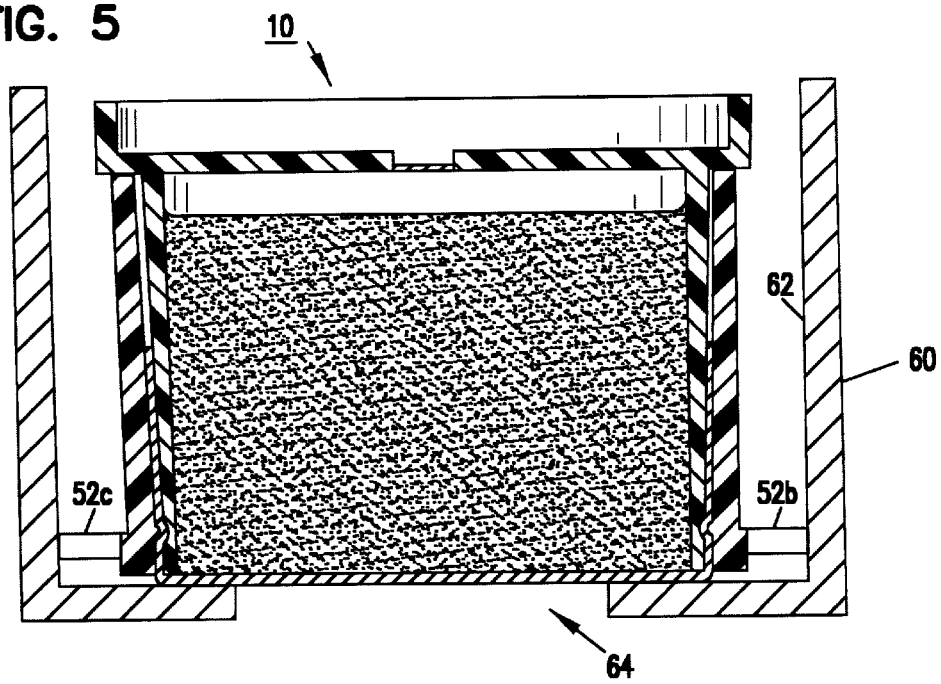
FIG. 5 is a cross-sectional view of the sample cup assembly of FIG. 1 installed in a sample cup holder of a spectroscopic instrument.

The main cell 12 includes a generally cylindrical side wall 18 having a first end 20 closed by a generally circular end wall 22 and an open second end 24. The side and end walls 18, 22 define an open cup-shape enclosure for accommodating a specimen to be analyzed (FIG. 5). A continuous groove 28 is defined in the outer surface 26 of the side wall 18 proximate the open second end 24. A generally annular reservoir side wall 32 depends from the outer periphery 30 of the end wall 22. The end wall 22 includes opening 33 (FIG. 2) closed by a thin membrane 34. The membrane 34 can be easily punctured to vent interior 36 of the main cell 12.

The sheet 16 of thin film material is flexible and transparent to the radiant energy used in the spectrochemical analysis. Such thin film materials are well known in the art.

The collar 14 is a generally cylindrical member having a first end 40, a second end 42 opposite the first end 40, an outer surface 44 and inner surface 46. The outer surface 44 of the collar 14 immediately adjacent the first end 40 thereof includes a circular peripheral flange 48. The inner surface 46 of the collar 14 includes a continuous (as shown) or segmented protrusion 50 adjacent the first end 40 thereof. When the collar 14 is assembled to the main cell 12, the protrusion 50 of the collar 14 snaps into the groove 28 on the outer surface 26 of the main cell side wall 18 thereby locking the collar 14 and main cell 12 together. Since the collar 14 of the sample cup assembly is virtually the same height as the side wall 18 of the main cell 12, the second end 42 of the collar abuts a flange-like edge 35 of the reservoir side wall 32.

Other embodiments of the sample cup assembly can use different methods for locking the collar 14 and the main cell 12 together. For example, the protrusion and groove arrangement can be omitted by tapering the collar 14 and the side wall 18 of the main cell 12 such that during assembly of the sample cup assembly 10, as the second end 42 of the collar 14 is moved toward the flange-like edge 35 of the reservoir side wall 32 of the main cell 12, a friction fit gradually develops therebetween which locks the collar 14 and main cell 12 together.

Figure 9:
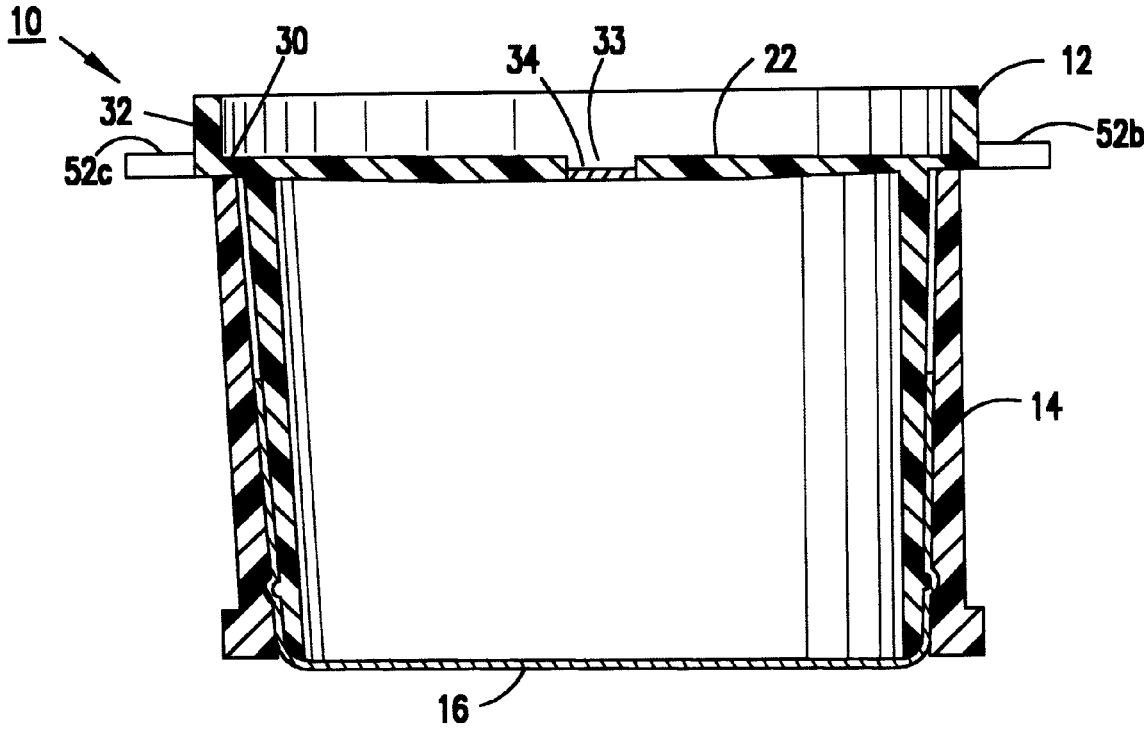
FIG. 9 is a cross-sectional view showing the centering system adapted to the main cell of the sample cup assembly.

In accordance with the present invention, the collar 14 further includes a centering system comprised of at least two and preferably three unitarily formed tabs 52*a*, 52*b*, 52*c* that extend outwardly from the circular peripheral flange 48. The tabs 52*a*, 52*b*, 52*c* of the collar 14 shown in the embodiment of FIGS. 1–3 are equi-spaced and of equal length. The tabs 52*a*, 52*b*, 52*c* extend radially outward from the central axis A–A' of the assembly 10. The tabs of the centering system of the invention can also be provided on the main cell as shown in FIG. 9.

The main cell 12 and the collar 14 are preferably fabricated from unrecycled natural polyethylene. This eliminates the potential possibility of introducing metallic contamination that may adversely affect the analysis of a sample substance. Polyethylene is one of a number of thermoplastic materials that can be utilized in this application because of its excellent mass attenuation properties encompassing the 1 to 12 Angstrom analytical wavelength range. In addition, polyethylene is resistant to chemical attack, temperature softening, and degradation from excitation energy sources, as well as exhibiting excellent tensile strength for adequate sample retention.

FIG. 5 shows the assembled sample cup assembly 10 installed in a sample cup holder 60 of a spectroscopic instrument. As can be seen, the tabs (52*b*, 52*c* visible) of the collar 14 slidingly abut against the inner surface 62 of the sample cup holder 60 thereby centering the sample cup assembly 10 with respect to the aperture 64 of the holder 60. The centering system of the invention thus enables the sample cup assembly 10 to be used in the sample cup holder of the spectroscopic instrument without an adapter.

Figure 4A:
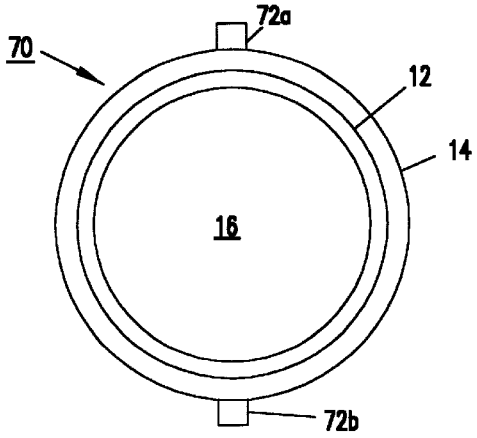
FIGS. 4A–4D are end views of sample cup assemblies with additional embodiments of the centering system.
Figure 4B:
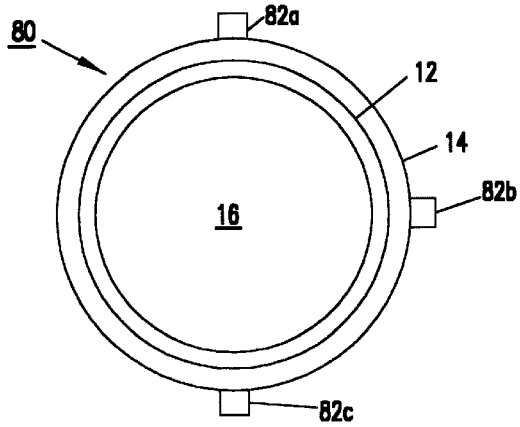
Figure 4C:
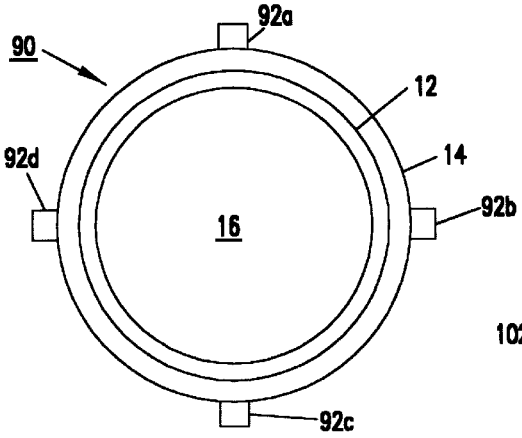
Figure 4D:
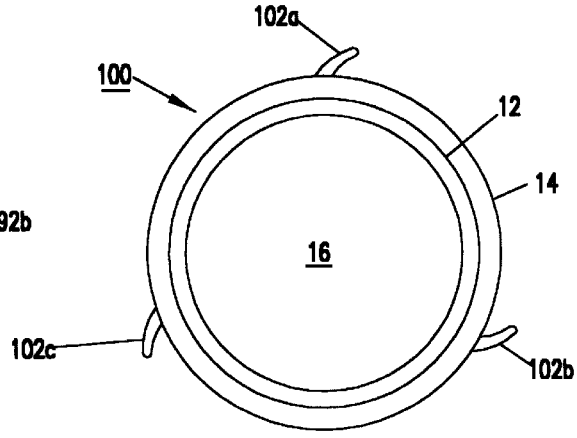

FIGS. 4A–4D show various other embodiments of the centering system of the present invention. In FIG. 4A, the collar 14 of the assembly 70 is provided with a centering system comprised of two equi-spaced, equal length tabs 72*a*, 72*b* that extend radially outward from the central axis A of the assembly 70. In FIG. 4B, the collar 14 of the assembly 80 is provided with a centering system comprised of three equal length tabs 82*a*, 82*b*, 82*c* that extend radially outward from the central axis A of the assembly 80. The first and third tabs 82*a*, 82*c* are spaced 180 degrees apart from one another while the second tab 82*b* is spaced 90 degrees apart from each of the first and third tabs 82*a*, 82*c*. In FIG. 4C, the collar 14 of the assembly 90 includes a centering system comprised of four equi-space, equal length tabs 92*a*, 92*b*, 92*c*, 92*d* that extend radially outward from the central axis A of the assembly 90. In FIG. 4D, the collar 14 of the assembly 100 is provided with a centering system comprised of three equi-spaced, flexible or resilient angled tabs 102*a*, 102*b*, 102*c*. Flexible tabs 102*a*, 102*b*, 102*c* allow the assembly 100 to be used in variously sized sample cup holders as the tabs bend to accommodate the inner diameter of the holder.

Figure 6:
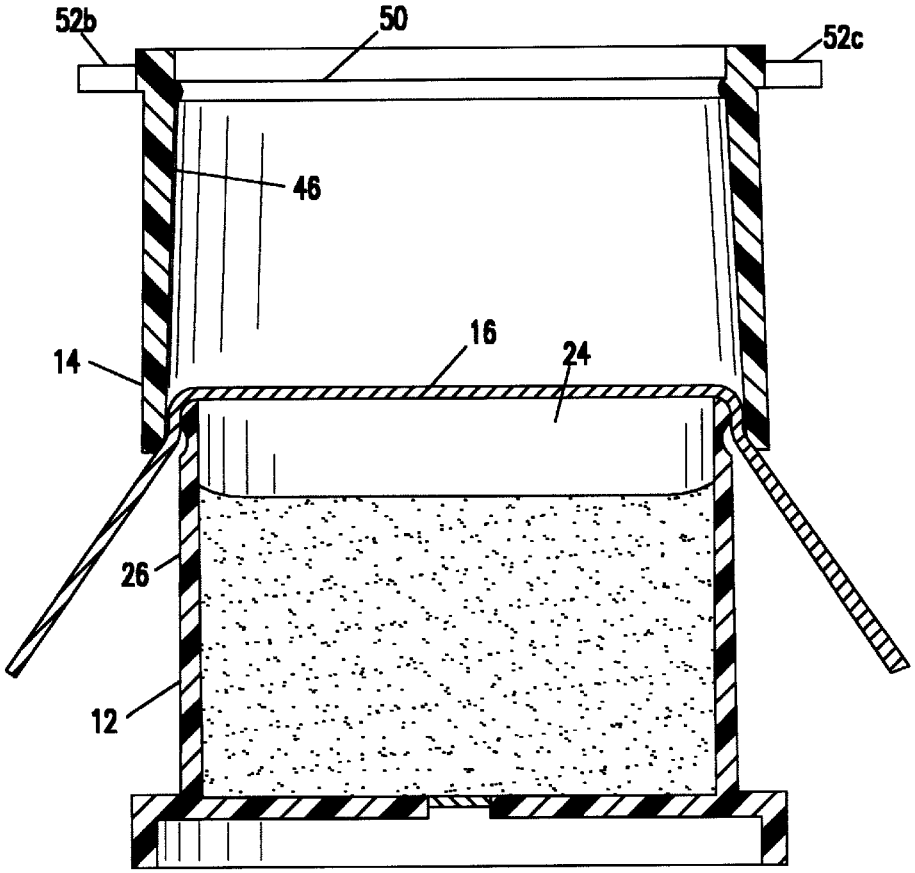
FIG. 6 is a cross-sectional view illustrating the assembly of the sample cup assembly of FIG. 1.

In FIG. 6, the components of the sample cup assembly 10 are conventionally assembled as described in U.S. Pat. No. 5,451,375. The collar 14 is advanced over the main cell 12 (which contains the specimen to be analyzed) such that the sheet of thin film material 16 becomes pinched between the outer surface of the main cell side wall and the inner surface of the collar 14. Consequently, the sheet of thin film material 16 is immediately pulled taut across the open end 24 of main cell 12. Assembly is completed once the collar 14 is advanced far enough over the main cell 12 so that the protrusion 50 on the inner surface 46 of collar 14 fits into the groove 28 on the outer surface 26 of the main cell side wall 18.

Once the sample cup 10 is assembled, the sheet of thin film material 16 is drawn tightly over the open end 24 of the cell body 12 creating a wrinkle-free sample surface plane for the spectroscopic analysis. The thin film material 16 creates a seal over the edge of the main cell 12 which is impermeable to the specimen contained therein.

Any time after the sample cup 10 is assembled, the specimen can be subjected to spectrochemical analysis. This normally requires inverting the sample cup assembly 10 so that the open end 24 of the main cell body 12 is facing downward and placing it into the sample cup holder of an associated spectroscopic instrument as shown for example in FIG. 5. At that time, any substance contained within the sample cup 10 will come in contact with the portion of thin film material 16 covering the open end 24 of the main cell 12. The specimen is then ready for analysis.

If venting is required during analysis of the specimen contained within the sample cup assembly 10, the membrane 34 can be ruptured with a blunt device.

Figure 7:
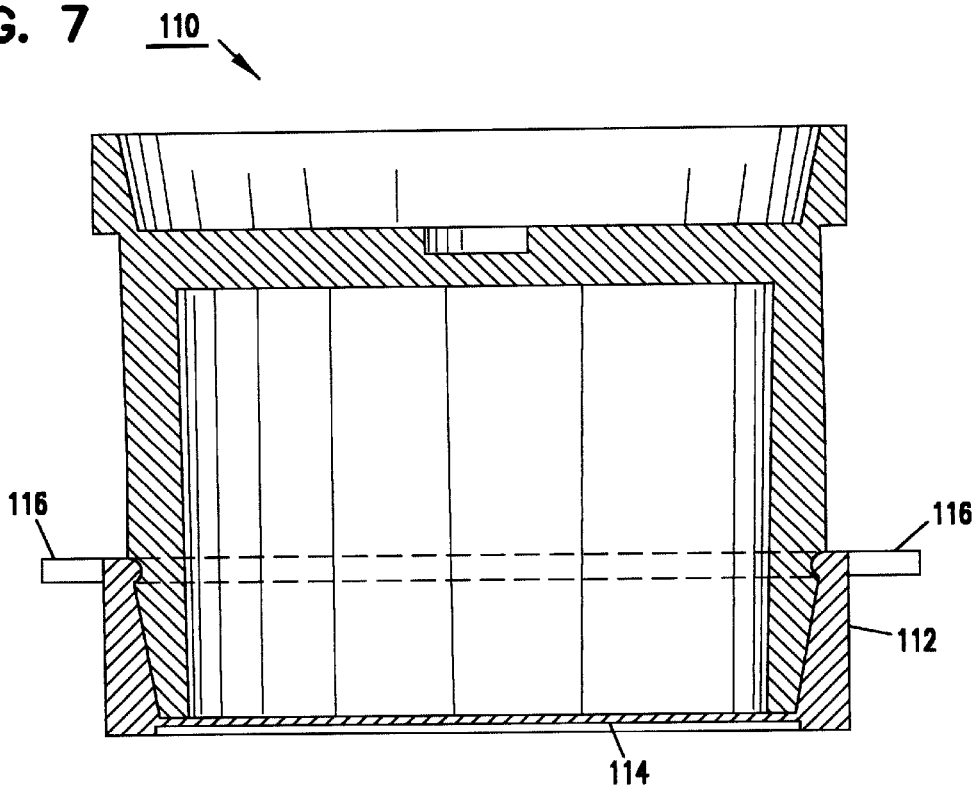
FIGS. 7 and 8 are cross-sectional views showing other types of sample cup assemblies which can utilize the centering system of the present invention.
Figure 8:
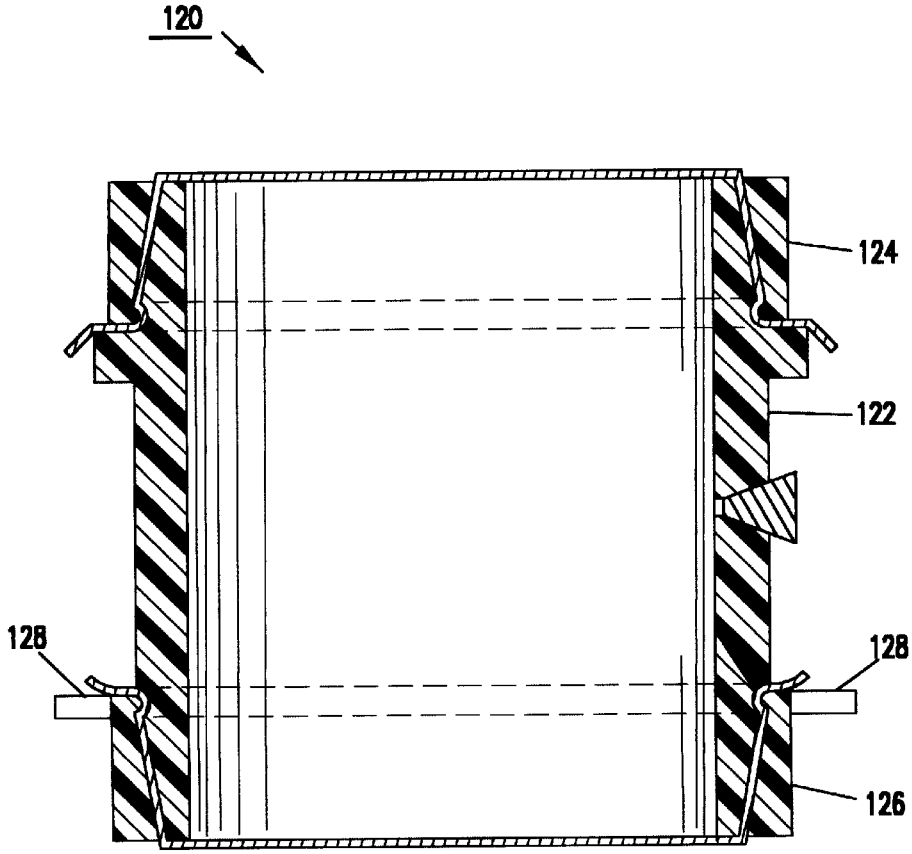

The centering system of the present invention can be used on other types of sample cup assemblies. For example, FIG. 7 shows the centering system of the invention comprised of tabs 116 adapted to a sample cup assembly 110 that utilizes a collar 112 with an integrally molded thin film 114 as disclosed in U.S. Pat. No. 4,643,033 to Solazzi. In another example, FIG. 8 shows the centering system of the invention comprised of tabs 128 adapted to a sample cup assembly 120 that utilizes a double open ended main cell 122 closed by two collar and thin film sheet assemblies 124, 126 as disclosed in U.S. Pat. No. 5,454,020 to Solazzi. The disclosures of U.S. Pat. No. 4,643,033 and 5,454,020 are incorporated herein by reference.

While the foregoing invention has been described with reference to the above embodiments, various modifications and changes can be made without departing from the spirit of the invention. Accordingly, such modifications and changes are considered to be within the scope of the appended claims.

What is claimed is:

1. A sample cup assembly for use in retaining a specimen, the sample cup assembly comprising:

a main cell for retaining the specimen, the main cell having an open end;

a collar for locating a thin film over the open end of the main cell such that the film sealingly closes the open end of the main cell; and at least two projections extending outwardly from one of the main cell and collar for centering the sample cup assembly within a sample cup holder of a spectroscopic instrument, wherein the projections are resilient.

2. The sample cup assembly according to claim 1, wherein the projections are equi-spaced.

3. The sample cup assembly according to claim 1, wherein the projections are equal in length.

4. The sample cup assembly according to claim 1, wherein the projections extend outwardly from the collar.

5. A sample cup assembly for use with an analytical instrument including a sample cup holder which has an inner diameter that is greater than that of the sample cup assembly, the sample cup assembly comprising:

a main cell for retaining a specimen to be analyzed by the analytical instrument, the main cell having an open end;

a collar for locating a thin film over the open end of the main cell such that the film sealingly closes the open end of the main cell; and at least two projections extending outwardly from one of the main cell and collar;

wherein the projections engage an interior surface of the sample cup holder when the sample cup assembly is installed therein, thereby centering the sample cup assembly within the sample cup holder, and wherein the projections are resilient.

6. The sample cup assembly according to claim 5, wherein the projections are equi-spaced.

7. The sample cup assembly according to claim 5, wherein the projections are equal in length.

8. The sample cup assembly according to claim 5, wherein the projections extend outwardly from the collar.

9. A sample cup assembly for use with an analytical instrument including a sample cup holder which has an inner diameter that is greater than that of the sample cup assembly, the sample cup assembly comprising:

a main cell for retaining a specimen to be analyzed by the analytical instrument, the main cell having opposing open ends;

first and second collars each of which locate a thin film over a respective one of the open ends of the main cell, the films sealingly closing the open ends of the main cell; and at least two projections extending from one of the main cell, the first collar, and the second collar;

wherein the projections engage an interior surface of the sample cup holder when the sample cup assembly is installed therein, thereby centering the sample cup assembly within the sample cup holder, wherein the projections are equi-spaced, and wherein the projections are resilient.

10. The sample cup assembly according to claim 9, wherein the projections are equi-spaced.

11. The sample cup assembly according to claim 9, wherein the projections are equal in length.

12. The sample cup assembly according to claim 9, wherein the projections extend woutwardly from one of the first and second collars.

13. The sample cup assembly according to claim 9, wherein at least one of the thin films is unitary with one of the first and second collars.

14. The sample cup assembly according to claim 9, wherein at least one of the thin films is separate from lone of the first and second collars.

* * * * *